US006324502B1

(12) United States Patent
Handel et al.

(10) Patent No.: US 6,324,502 B1
(45) **Date of Patent: *Nov. 27, 2001**

(54) NOISY SPEECH AUTOREGRESSION PARAMETER ENHANCEMENT METHOD AND APPARATUS

(75) Inventors: Peter Handel, Uppsala; Patrik Sörqvist, Spånga, both of (SE)

(73) Assignee: Telefonaktiebolaget LM Ericsson (publ), Stockholm (SE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/781,515

(22) Filed: Jan. 9, 1997

(30) Foreign Application Priority Data

Feb. 1, 1996 (SE) ..... 9600363

(51) Int. Cl.[7] ..... G10L 9/08
(52) U.S. Cl. ..... 704/226; 704/228
(58) Field of Search ..... 704/226, 227, 704/228

(56) References Cited

U.S. PATENT DOCUMENTS

| | | | | |
|---|---|---|---|---|
| 4,618,982 | * | 10/1986 | Horvath | 381/36 |
| 4,628,529 | | 12/1986 | Borth et al. . | |
| 5,295,225 | * | 3/1994 | Kane et al. | 704/226 |
| 5,319,703 | * | 6/1994 | Drory | 379/351 |
| 5,579,435 | | 11/1996 | Jansson . | |

FOREIGN PATENT DOCUMENTS

WO95/15550 6/1995 (WO) .

OTHER PUBLICATIONS

Patent Abstracts of Japan, vol. 14, No. 298, P–1068, JP, A, 2–93697 (Apr. 4, 1990).

S.A. Dimino et al., "Estimating the Energy Contour of Noise–Corrupted Speech Signals by Autocorrelation Extrapolation," IEEE Robotics, Vision and Sensors, Signal Processing and Control, pp. 2015–2018 (Nov. 15–19, 1993).

W. Du et al., "Speech Enhancement Based on Kalman Filtering and EM Algorithm," IEEE Pacific Rim Conference on Communications, Computers and Signal Processing, vol. 1, pp. 142–145 (May 9–10, 1991).

D.K. Freeman et al., "The Voice Activity Detector for the Pan–European Digital Cellular Mobile Telephone Service," 1989 IEEE International Conference on Acoustics, Speech and Signal Processing, vol. 1, pp. 489–502 (May 23–26, 1989).

J.D. Gibson et al., "Filtering of Colored Noise for Speech Enhancement and Coding," IEEE Transactions on Signal Processing, vol. 39, No. 8, pp. 1732–1742 (Aug. 1991).

B–G Lee et al., "A Sequential Algorithm for Robust Parameter Estimation and Enhancement of Noisy Speech," Proceedings of the International Symposium on Circuits and Systems (ISCS), vol. 1, pp. 243–246 (May 3–6, 1993).

(List continued on next page.)

*Primary Examiner*—David R. Hudspeth
*Assistant Examiner*—Harold Zintel
(74) *Attorney, Agent, or Firm*—Burns, Doane, Swecker & Mathis, L.L.P.

(57) ABSTRACT

Noisy speech parameters are enhanced by determining a background noise power spectral density (PSD) estimate, determining noisy speech parameters, determining a noisy speech PSD estimate from the speech parameters, subtracting a background noise PSD estimate from the noisy speech PSD estimate, and estimating enhanced speech parameters from the enhanced speech PSD estimate.

20 Claims, 5 Drawing Sheets

OTHER PUBLICATIONS

K.Y. Lee et al., "Robust Estimation of AR Parameters and Its Application for Speech Enhancement," IEEE International Conference on Acoustics, Speech and Signal Processing, vol. 1, pp. I–309 through I–312 (Mar. 23–26, 1992).

J.S. Lim et al., "All–Pole Modeling of Degraded Speech," IEEE Transactions on Acoustics, Speech, and Signal Processing, vol. ASSP–26, No. 3, pp. 197–210 (Jun. 1978).

T. Söderström et al., "An Indirect Prediction Error Method for System Identification," Automatica, vol. 27, No. 1, pp. 183–188 (Jan. 1991).

Boll "Suppression of Acoustic Noise In Speech Using Spectral Subtraction" IEEE, transactions vol. 2, Apr. 1979.*

Hansen et al "Constrained Iterative Speech Enhancement with Application to Speech Recognition" IEEE transactions vol. 39, Apr. 1991.*

Deller et al. "Discrete–Time Processing of Speech Signals" Prentice Hall, pp. 231, 273, 285, 297–298, 342, 343, 507–513, 521, 527, 1993.*

Deller et al, Discrete–Time Processing of Speech Signals, Prentice Hall, pp. 511–513, 1987.*

* cited by examiner

NOISY SPEECH AUTOREGRESSION PARAMETER ENHANCEMENT METHOD AND APPARATUS

BACKGROUND

The present invention relates to a noisy speech parameter enhancement method and apparatus that may be used in, for example noise suppression equipment in telephony systems.

A common signal processing problem is the enhancement of a signal from its noisy measurement. This can for example be enhancement of the speech quality in single microphone telephony systems, both conventional and cellular, where the speech is degraded by colored noise, for example car noise in cellular systems.

An often used noise suppression method is based on Kalman filtering, since this method can handle colored noise and has a reasonable numerical complexity. The key reference for Kalman filter based noise suppressors is Reference [1]. However, Kalman filtering is a model based adaptive method, where speech as well as noise are modeled as, for example, autoregressive (AR) processes. Thus, a key issue in Kalman filtering is that the filtering algorithm relies on a set of unknown parameters that have to be estimated. The two most important problems regarding the estimation of the involved parameters are that (i) the speech AR parameters are estimated from degraded speech data, and (ii) the speech data are not stationary. Thus, in order to obtain a Kalman filter output with high audible quality, the accuracy and precision of the estimated parameters is of great importance.

SUMMARY

An object of the present invention is to provide an improved method and apparatus for estimating parameters of noisy speech. These enhanced speech parameters may be used for Kalman filtering noisy speech in order to suppress the noise. However, the enhanced speech parameters may also be used directly as speech parameters in speech encoding.

The above object is solved by a method of enhancing noisy speech parameters that includes the steps of determining a background noise power spectral density estimate at M frequencies, where M is a predetermined positive integer, from a first collection of background noise samples; estimating p autoregressive parameters, where p is a predetermined positive integer significantly smaller than M, and a first residual variance from a second collection of noisy speech samples; determining a noisy speech power spectral density estimate at said M frequencies from said p autoregressive parameters and said first residual variance; determining an enhanced speech power spectral density estimate by subtracting said background noise spectral density estimate multiplied by a predetermined positive factor from said noisy speech power spectral density estimate; and determining r enhanced autoregressive parameters, where r is a predetermined positive integer, and an enhanced residual variance from said enhanced speech power spectral density estimate.

The above object also is solved by an apparatus for enhancing noisy speech parameters that includes a device for determining a background noise power spectral density estimate at M frequencies, where M is a predetermined positive integer, from a first collection of background noise samples; a device for estimating p autoregressive parameters, where p is a predetermined positive integer significantly smaller than M, and a first residual variance from a second collection of noisy speech samples; a device for determining a noisy speech power spectral density estimate at said M frequencies from said p autoregressive parameters and said first residual variance; a device for determining an enhanced speech power spectral density estimate by subtracting said background noise spectral density estimate multiplied by a predetermined factor from said noisy speech power spectral density estimate; and a device for determining r enhanced autoregressive parameters, where r is a predetermined positive integer, and an enhanced residual variance from said enhanced speech power spectral density.

BRIEF DESCRIPTION OF THE DRAWINGS

The invention, together with further objects and advantages thereof, may best be understood by making reference to the following description taken together with the accompanying drawings, of which.

DETAILED DESCRIPTION

In speech signal processing the input speech is often corrupted by background noise. For example, in hands-free mobile telephony the speech to background noise ratio may be as low as, or even below, 0 dB. Such high noise levels severely degrade the quality of the conversation, not only due to the high noise level itself, but also due to the audible artifacts that are generated when noisy speech is encoded and carried through a digital communication channel. In order to reduce such audible artifacts the noisy input speech may be pre-processed by some noise reduction method, for example by Kalman filtering as in Reference [1].

In some noise reduction methods (for example in Kalman filtering) autoregressive (AR) parameters are of interest. Thus, accurate AR parameter estimates from noisy speech data are essential for these methods in order to produce an enhanced speech output with high audible quality. Such a noisy speech parameter enhancement method will now be described with reference to FIGS. 1–6.

Figure 1:
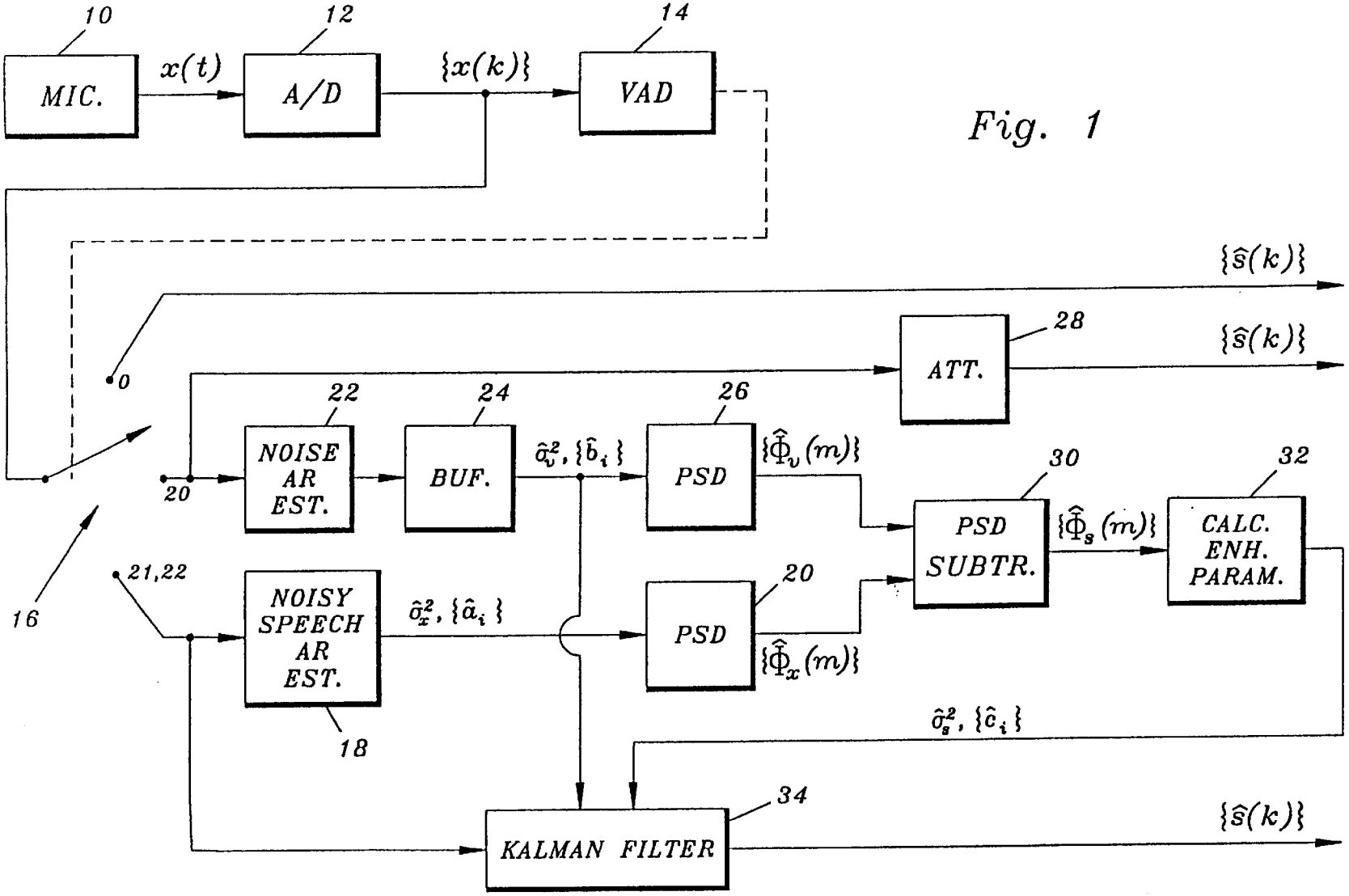
FIG. 1 is a block diagram in an apparatus in accordance with the present invention.

In FIG. 1 a continuous analog signal x(t) is obtained from a microphone 10. Signal x(t) is forwarded to an A/D converter 12. This A/D converter (and appropriate data buffering) produces frames {x(k)} of audio data (containing either speech, background noise or both). An audio frame typically may contain between 100–300 audio samples at 8000 Hz sampling rate. In order to simplify the following discussion, a frame length N=256 samples is assumed. The audio frames {x(k)} are forwarded to a voice activity detector (VAD) 14, which controls a switch 16 for directing audio frames {x(k)} to different blocks in the apparatus depending on the state of VAD 14.

Figure 2:
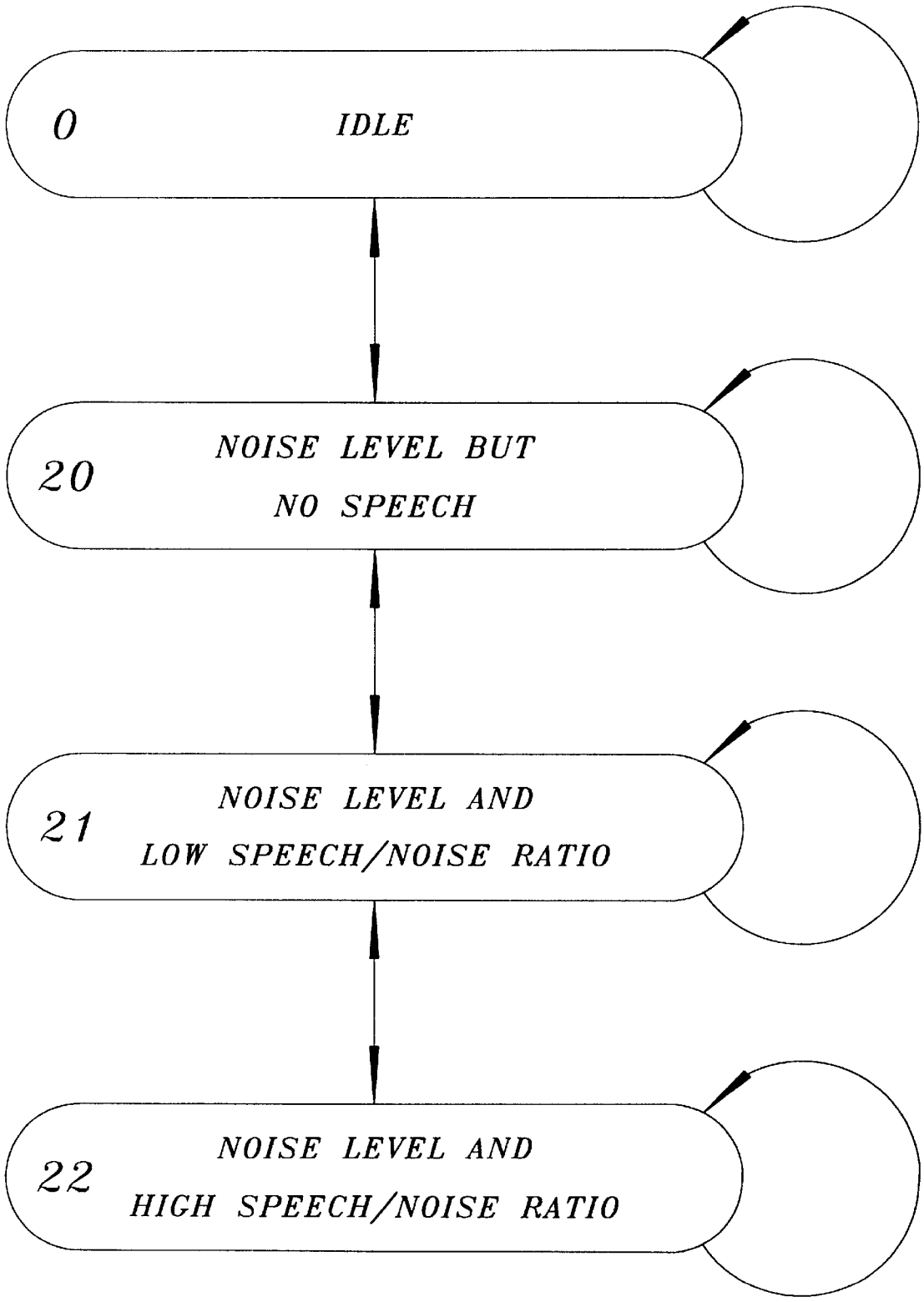
FIG. 2 is a state diagram of a voice activity detector (VAD) used in the apparatus of FIG. 1.

VAD 14 may be designed in accordance with principles that are discussed in Reference [2], and is usually implemented as a state machine. FIG. 2 illustrates the possible states of such a state machine. In state 0 VAD 14 is idle or "inactive", which implies that audio frames {x(k)} are not further processed. State 20 implies a noise level and no speech. State 21 implies a noise level and a low speech/noise ratio. This state is primarily active during transitions between speech activity and noise. Finally, state 22 implies a noise level and high speech/noise ratio.

An audio frame {x(k)} contains audio samples that may be expressed as $$x(k) = s(k) + v(k) \quad k = 1, \ldots, N \tag{1}$$

where x(k) denotes noisy speech samples, s(k) denotes speech samples and v(k) denotes colored additive background noise. Noisy speech signal x(k) is assumed stationary over a frame. Furthermore, speech signal s(k) may be described by an autoregressive (AR) model of order r $$s(k) = -\sum_{i=1}^{r} c_i s(k-i) + w_s(k) \tag{2}$$

where the variance of $w_s(k)$ is given by $\sigma_s^2$. Similarly, v(k) may be described by an AR model of order q $$v(k) = -\sum_{i=1}^{q} b_i v(k-i) + w_v(k) \tag{3}$$

where the variance of $w_v(k)$ is given by $\sigma_v^2$. Both r and q are much smaller than the frame length N. Normally, the value of r preferably is around 10, while q preferably has a value in the interval 0–7, for example 4 (q=0 corresponds to a constant power spectral density, i.e. white noise). Further information on AR modelling of speech may be found in Reference [3].

Furthermore, the power spectral density $\Phi_x(\omega)$ of noisy speech may be divided into a sum of the power spectral density $\Phi_s(\omega)$ of speech and the power spectral density $\Phi_v(\omega)$ of background noise, that is $$\Phi_x(\omega)=\Phi_s(\omega)+\Phi_v(\omega) \tag{4}$$

from equation (2) it follows that $$\Phi_s(\omega) = \frac{\sigma_s^2}{\left|1 + \sum_{m=1}^{r} c_m e^{-i\omega m}\right|^2} \tag{5}$$

Similarly from equation (3) it follows that $$\Phi_v(\omega) = \frac{\sigma_v^2}{\left|1 + \sum_{m=1}^{q} b_m e^{-i\omega m}\right|^2} \tag{6}$$

From equations (2)–(3) it follows that x(k) equals an autoregressive moving average (ARMA) model with power spectral density $\Phi_x(\omega)$. An estimate of $\Phi_x(\omega)$ (here and in the sequel estimated quantities are denoted by a hat "^") can be achieved by an autoregressive (AR) model, that is $$\hat{\Phi}_x(\omega) \approx \frac{\hat{\sigma}_x^2}{\left|1 + \sum_{m=1}^{p} \hat{a}_m e^{-i\omega m}\right|^2} \tag{7}$$

where $\{\hat{a}_i\}$ and $\hat{\sigma}_x^2$ are the estimated parameters of the AR model $$x(k) = -\sum_{i=1}^{p} a_i x(k-i) + w_x(k) \tag{8}$$

where the variance of $w_x(k)$ is given by $\sigma_x^2$, and where $r \leqq p \leqq N$. It should be noted that $\hat{\Phi}_x(\omega)$ in equation (7) is not a statistically consistent estimate of $\Phi_x(\omega)$. In speech signal processing this is, however, not a serious problem, since x(k) in practice is far from a stationary process.

In FIG. 1, when VAD 14 indicates speech (states 21 and 22 in FIG. 2) signal x(k) is forwarded to a noisy speech AR estimator 18, that estimates parameters $\sigma_x^2$, $\{a_i\}$ in equation (8). This estimation may be performed in accordance with Reference [3] (in the flow chart of FIG. 3 this corresponds to step 120). The estimated parameters are forwarded to block 20, which calculates an estimate of the power spectral density of input signal x(k) in accordance with equation (7) (step 130 in FIG. 3).

It is an essential feature of the present invention that background noise may be treated as long-time stationary, that is stationary over several frames. Since speech activity is usually sufficiently low to permit estimation of the noise model in periods where s(k) is absent, the long-time stationarity feature may be used for power spectral density subtraction of noise during noisy speech frames by buffering noise model parameters during noise frames for later use during noisy speech frames. Thus, when VAD 14 indicates background noise (state 20 in FIG. 2), the frame is forwarded to a noise AR parameter estimator 22, which estimates parameters $\sigma_v^2$ and $\{b_i\}$ of the frame (this corresponds to step 140 in the flow chart in FIG. 3). As mentioned above the estimated parameters are stored in a buffer 24 for later use during a noisy speech frame (step 150 in FIG. 3). When these parameters are needed (during a noisy speech frame) they are retrieved from buffer 24. The parameters are also forwarded to a block 26 for power spectral density estimation of the background noise, either during the noise frame (step 160 in FIG. 3), which means that the estimate has to be buffered for later use, or during the next speech frame, which means that only the parameters have to be buffered. Thus, during frames containing only background noise the estimated parameters are not actually used for enhancement purposes. Instead the noise signal is forwarded to attenuator 28 which attenuates the noise level by, for example, 10 dB (step 170 in FIG. 3).

The power spectral density (PSD) estimate $\hat{\Phi}_x(\omega)$, as defined by equation (7), and the PSD estimate $\hat{\Phi}_v(\omega)$, as defined by an equation similar to (6) but with "^" signs over the AR parameters and $\sigma_v^2$, are functions of the frequency ω. The next step is to perform the actual PSD subtraction, which is done in block 30 (step 180 in FIG. 3). In accordance with the invention the power spectral density of the speech signal is estimated by $$\hat{\Phi}_s(\omega)=\hat{\Phi}_x(\omega)-\delta\hat{\Phi}_v(\omega) \tag{9}$$

where δ is a scalar design variable, typically lying in the interval $0<\delta<4$. In normal cases δ has a value around 1 (δ=1 corresponds to equation (4)).

It is an essential feature of the present invention that the enhanced PSD $\hat{\Phi}_s(\omega)$ is sampled at a sufficient number of frequencies ω in order to obtain an accurate picture of the enhanced PSD. In practice the PSD is calculated at a discrete set of frequencies, $$\omega = \frac{2\pi m}{M} \quad m = 1, \ldots, M \tag{10}$$

see Reference [3], which gives a discrete sequence of PSD estimates $$\{\hat{\Phi}_s(1), \hat{\Phi}_s(2), \ldots, \hat{\Phi}_s(M)\} = \{\hat{\Phi}_s(m)\} \quad m = 1, \ldots M \tag{11}$$

Figure 4:
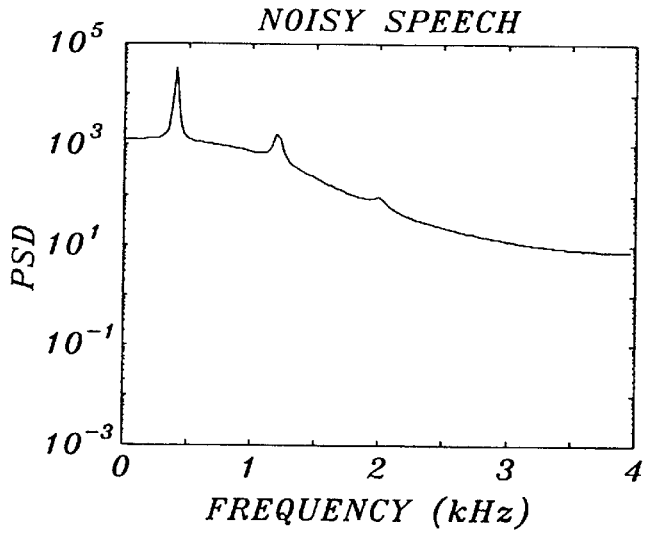
FIG. 4 illustrates features of the power spectral density (PSD) of noisy speech.
Figure 5:
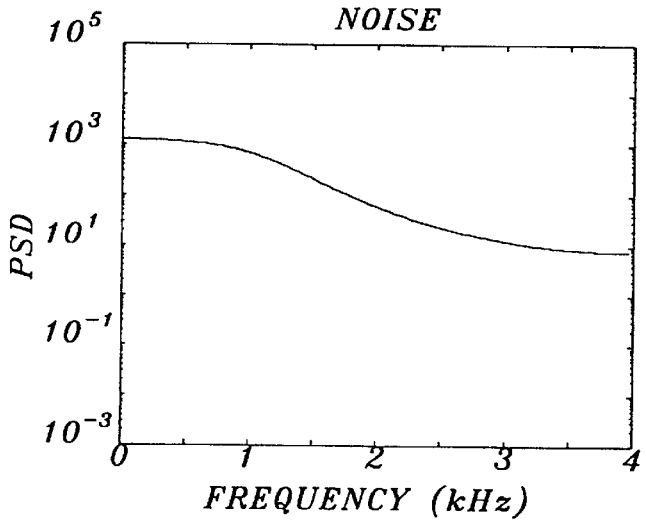
FIG. 5 illustrates a similar PSD for background noise.
Figure 6:
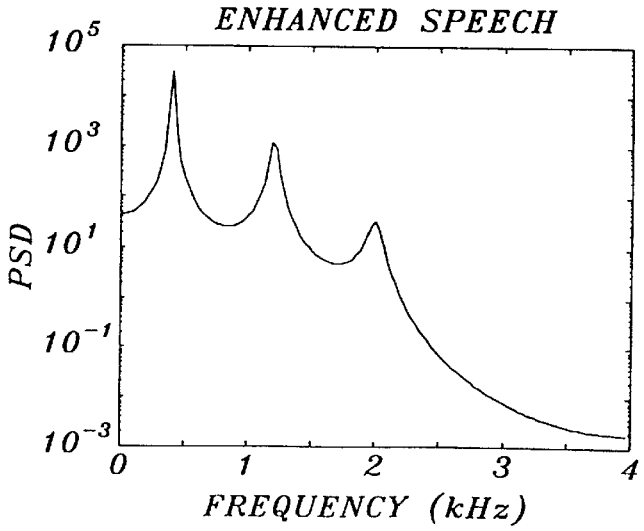
FIG. 6 illustrates the resulting PSD after subtraction of the PSD in FIG. 5 from the PSD in FIG. 4.

This feature is further illustrated by FIGS. 4–6. FIG. 4 illustrates a typical PSD estimate $\hat{\Phi}_x(\omega)$ of noisy speech. FIG. 5 illustrates a typical PSD estimate $\hat{\Phi}_v(\omega)$ of background noise. In this case the signal-to-noise ratio between the signals in FIGS. 4 and 5 is 0 dB. FIG. 6 illustrates the enhanced PSD estimate $\hat{\omega}_s(\omega)$ after noise subtraction in accordance with equation (9), where in this case δ=1. Since the shape of PSD estimate $\hat{\Phi}_s(\omega)$ is important for the estimation of enhanced speech parameters (will be described below), it is an essential feature of the present invention that the enhanced PSD estimate $\hat{\Phi}_s(\omega)$ is sampled at a sufficient number of frequencies to give a true picture of the shape of the function (especially of the peaks).

In practice $\hat{\Phi}_s(\omega)$ is sampled by using equations (6) and (7). In, for example, equation (7) $\hat{\Phi}_x(\omega)$ may be sampled by using the Fast Fourier Transform (FFT). Thus, 1, $a_1$, $a_2$ . . . , $a_p$ are considered as a sequence, the FFT of which is to be calculated. Since the number of samples M must be larger than p (p is approximately 10–20) it may be necessary to zero pad the sequence. Suitable values for M are values that are a power of 2, for example, 64, 128, 256. However, usually the number of samples M may be chosen smaller than the frame length (N=256 in this example). Furthermore, since $\hat{\Phi}_s(\omega)$ represents the spectral density of power, which is a non-negative entity, the sampled values of $\hat{\Phi}_s(\omega)$ have to be restricted to non-negative values before the enhanced speech parameters are calculated from the sampled enhanced PSD estimate $\hat{\Phi}_s(\omega)$.

Figure 3:
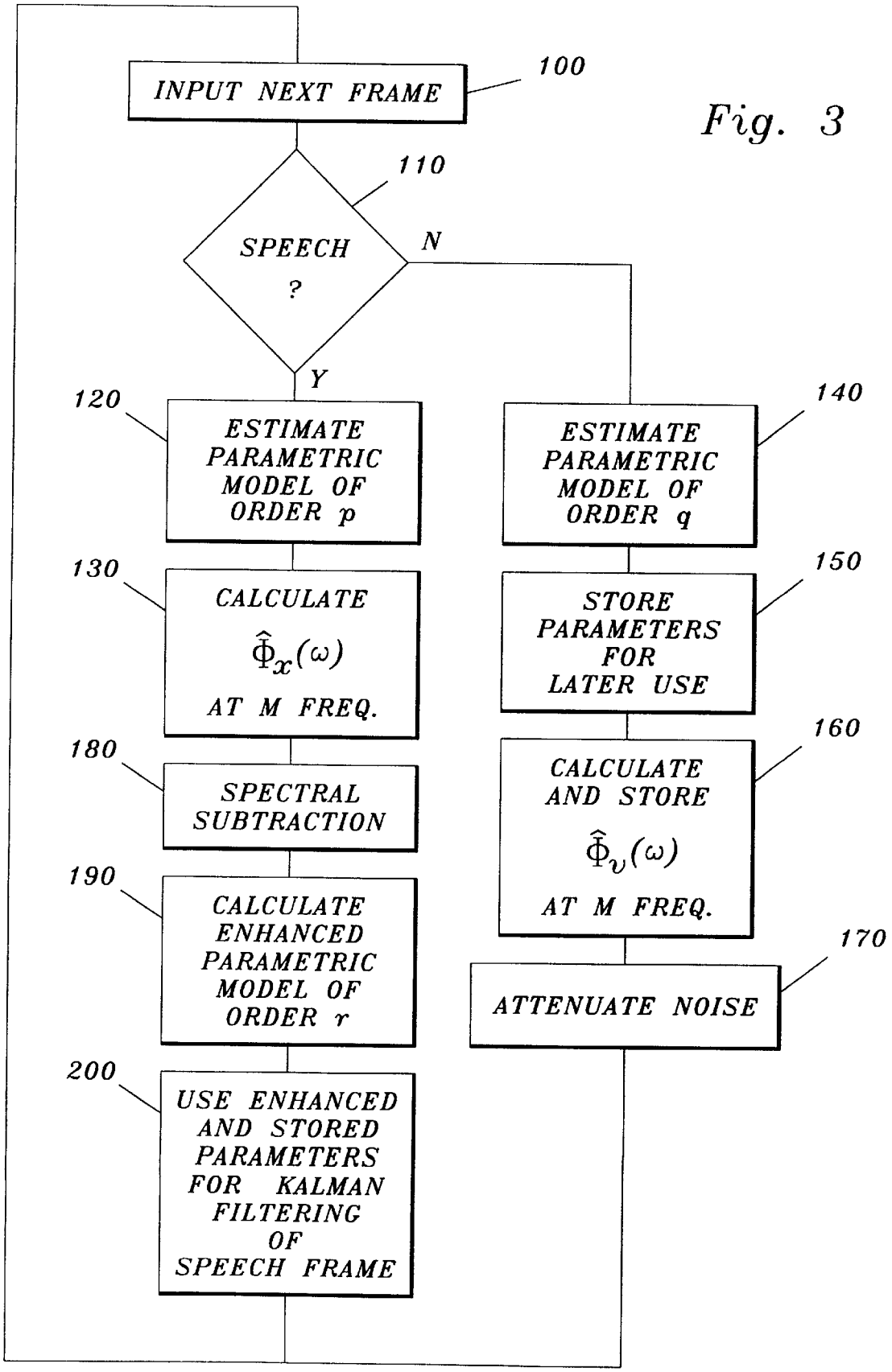
FIG. 3 is a flow chart illustrating the method in accordance with the present invention.

After block 30 has performed the PSD subtraction the collection $\{\hat{\Phi}_s(m)\}$ of samples is forwarded to a block 32 for calculating the enhanced speech parameters from the PSD-estimate (step 190 in FIG. 3). This operation is the reverse of blocks 20 and 26, which calculated PSD-estimates from AR parameters. Since it is not possible to explicitly derive these parameters directly from the PSD estimate, iterative algorithms have to be used. A general algorithm for system identification, for example as proposed in Reference [4], may be used.

A preferred procedure for calculating the enhanced parameters is also described in the APPENDIX.

The enhanced parameters may be used either directly, for example, in connection with speech encoding, or may be used for controlling a filter, such as Kalman filter 34 in the noise suppressor of FIG. 1 (step 200 in FIG. 3). Kalman filter 34 is also controlled by the estimated noise AR parameters, and these two parameter sets control Kalman filter 34 for filtering frames {x(k)} containing noisy speech in accordance with the principles described in Reference [1].

If only the enhanced speech parameters are required by an application it is not necessary to actually estimate noise AR parameters (in the noise suppressor of FIG. 1 they have to be estimated since they control Kalman filter 34). Instead the long-time stationarity of background noise may be used to estimate $\hat{\Phi}_v(\omega)$. For example, it is possible to use $$\hat{\Phi}_v(\omega)^{(m)} = \rho\hat{\Phi}_v(\omega)^{(m-1)} + (1-\rho)\overline{\Phi}_v(\omega) \tag{12}$$

where $\hat{\Phi}_v(\omega)^{(m)}$ is the (running) averaged PSD estimate based on data up to and including frame number m, and $\overline{\Phi}_v(\omega)$ is the estimate based on the current frame ($\overline{\Phi}_v(\omega)$ may be estimated directly from the input data by a periodogram (FFT)). The scalar ρ ∈(0,1) is tuned in relation to the assumed stationarity of v(k). An average over τ frames roughly corresponds to ρ implicitly given by $$\tau = \frac{2}{1-\rho} \tag{13}$$

Parameter ρ may for example have a value around 0.95.

In a preferred embodiment averaging in accordance with equation (12) is also performed for a parametric PSD estimate in accordance with equation (6). This averaging procedure may be a part of block 26 in FIG. 1 and may be performed as a part of step 160 in FIG. 3.

In a modified version of the embodiment of FIG. 1 attenuator 28 may be omitted. Instead Kalman filter 34 may be used as an attenuator of signal x(k). In this case the parameters of the background noise AR model are forwarded to both control inputs of Kalman filter 34, but with a lower variance parameter (corresponding to the desired attenuation) on the control input that receives enhanced speech parameters during speech frames.

Furthermore, if the delays caused by the calculation of enhanced speech parameters is considered too long, according to a modified embodiment of the present invention it is possible to use the enhanced speech parameters for a current speech frame for filtering the next speech frame (in this embodiment speech is considered stationary over two frames). In this modified embodiment enhanced speech parameters for a speech frame may be calculated simultaneously with the filtering of the frame with enhanced parameters of the previous speech frame.

The basic algorithm of the method in accordance with the present invention may now be summarized as follows:

In speech pauses do estimate the PSD $\hat{\Phi}_v(\omega)$ of the background noise for a set of M frequencies. Here any kind of PSD estimator may be used, for example parametric or non-parametric (periodogram) estimation. Using long-time averaging in accordance with equation (12) reduces the error variance of the PSD estimate.

For speech activity: in each frame do based on {x(k)} estimate the AR parameters $\{a_i\}$ and the residual error variance $\sigma_x^2$ of the noisy speech.

based on these noisy speech parameters, calculate the PSD estimate $\Phi_x(\omega)$ of the noisy speech for a set of M frequencies.

based on $\hat{\Phi}_x(\omega)$ and $\hat{\Phi}_v(\omega)$, calculate an estimate of the speech PSD $\hat{\Phi}_s(\omega)$ using equation (9). The scalar δ is a design variable approximately equal to 1.

based on the enhanced PSD $\hat{\Phi}_s(\omega)$, calculate the enhanced AR parameters and the corresponding residual variance.

Most of the blocks in the apparatus of FIG. 1 are preferably implemented as one or several micro/signal processor combinations (for example blocks 14, 18, 20, 22, 26, 30, 32 and 34 ).

In order to illustrate the performance of the method in accordance with the present invention, several simulation experiments were performed. In order to measure the improvement of the enhanced parameters over original parameters, the following measure was calculated for 200 different simulations $$V = \frac{1}{200}\sum_{m=1}^{200}\left(\frac{\sum_{k=1}^{M}\left[\log(\hat{\Phi}(k)) - \log(\hat{\Phi}_s(k))\right]^2}{\sum_{k=1}^{M}\log(\hat{\Phi}_s(k))^2}\right)^{(m)} \tag{14}$$

Figure 7:
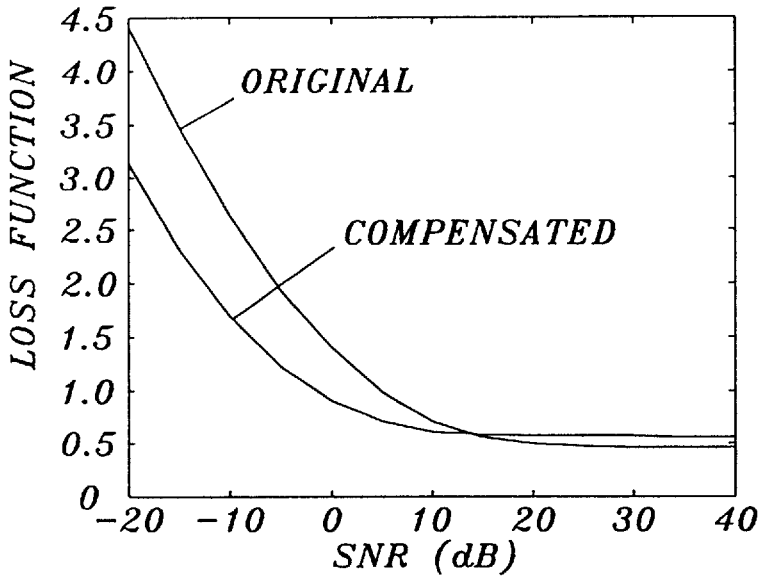
FIG. 7 illustrates the improvement obtained by the present invention in the form of a loss function.
Figure 8:
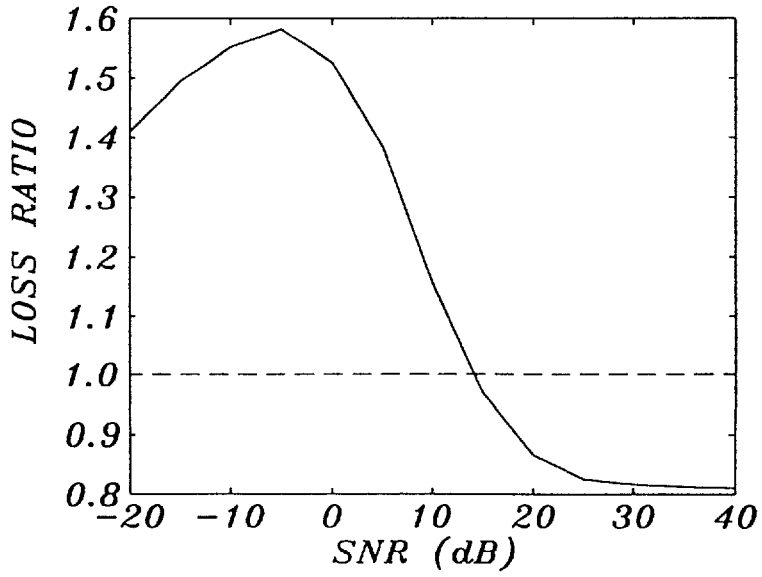
FIG. 8 illustrates the improvement obtained by the present invention in the form of a loss ratio.

This measure (loss function) was calculated for both noisy and enhanced parameters, i.e. $\hat{\Phi}(\kappa)$ denotes either $\hat{\Phi}_x(\kappa)$ or $\hat{\Phi}_s(\kappa)$. In equation (14), $(\cdot)^{(m)}$ denotes the result of simulation number m. The two measures are illustrated in FIG. 7. FIG. 8 illustrates the ratio between these measures. From the figures it may be seen that for low signal-to-noise ratios (SNR<15 dB) the enhanced parameters outperform the noisy parameters, while for high signal-to-noise ratios the performance is approximately the same for both parameter sets. At low SNR values the improvement in SNR between enhanced and noisy parameters is of the order of 7 dB for a given value of measure V.

It will be understood by those skilled in the art that various modifications and changes may be made to the present invention without departure from the spirit and scope thereof, which is defined by the appended claims.

Appendix

In order to obtain an increased numerical robustness of the estimation of enhanced parameters, the estimated enhanced PSD data in equation (11) are transformed in accordance with the following non-linear data transformation $$\Gamma=(\hat{\gamma}(1), \hat{\gamma}(2), \ldots, \hat{\gamma}(M))^T \tag{15}$$

where $$\hat{\gamma}(k) = \begin{cases} -\log(\hat{\Phi}_s(k)) & \hat{\Phi}_s(k) > \epsilon \\ -\log(\epsilon) & \hat{\Phi}_s(k) \le \epsilon \end{cases} \quad k = 1, \ldots, M \tag{16}$$

and where $\epsilon$ is a user chosen or data dependent threshold that ensures that $\hat{\gamma}(\kappa)$ is real valued. Using some rough approximations (based on a Fourier series expansion, an assumption on a large number of samples, and high model orders) one has in the frequency interval of interest $$E([\hat{\Phi}_s(i) - \Phi_s(i)][\hat{\Phi}_s(k) - \Phi_s(k)]) \approx \begin{cases} \frac{2r}{N}\Phi_s^2(k) & k = i \\ 0 & k \ne i \end{cases} \tag{17}$$

Equation (17) gives $$E([\hat{\gamma}(i) - \gamma(i)][\hat{\gamma}(k) - \gamma(k)]) \approx \begin{cases} \frac{2r}{N} & k = i \\ 0 & k \ne i \end{cases} \tag{18}$$

In equation (18) the expression $\gamma(\kappa)$ is defined by $$\gamma(k) = E[\hat{\gamma}(k)] = -\log(\sigma_s^2) + \log\left(\left|1 + \sum_{m=1}^{r} c_m e^{-i\frac{2\pi k}{M}m}\right|^2\right) \tag{19}$$

Assuming that one has a statistically efficient estimate $\hat{\Gamma}$, and an estimate of the corresponding covariance matrix $\hat{P}_\Gamma$, the vector $$\chi=(\sigma_s^2, C_1, C_2, \ldots, C_r)^T \tag{20}$$

and its covariance matrix $P_\chi$ may be calculated in accordance with $$G(k) = \left[\left.\frac{\partial\Gamma(\chi)}{\partial\chi}\right|_{\chi=\hat{\chi}(k)}\right]^T \tag{21}$$

$$\hat{P}_\chi(k) = \left[G(k)\hat{P}_\Gamma^{-1}G^T(k)\right]^{-1}$$

$$\hat{\chi}(k+1) = \hat{\chi}(k) + \hat{P}_\chi(k)G(k)\hat{P}_\Gamma^{-1}\left[\hat{\Gamma} - \Gamma(\hat{\chi}(k))\right]$$

with initial estimates $\hat{\Gamma}$, $\hat{P}_\Gamma$ and $\hat{\chi}(0)$.

In the above algorithm the relation between $\Gamma(\chi)$ and $\chi$ is given by $$\Gamma(\chi)=(\gamma(1), \gamma(2), \ldots, \gamma(M))^T \tag{22}$$

where $\gamma(\kappa)$ is given by (19). With $$\Psi_k = \begin{pmatrix} \frac{\partial\gamma(k)}{\partial(\sigma_s^2)} \\ \frac{\partial\gamma(k)}{\partial c_1} \\ \frac{\partial\gamma(k)}{\partial c_2} \\ \vdots \\ \frac{\partial\gamma(k)}{\partial c_r} \end{pmatrix} = \begin{pmatrix} -1 \\ 2\mathrm{Re}\left[\frac{e^{-i\frac{2\pi k}{M}}}{1 + \sum_{m=1}^{r} c_m e^{-i\frac{2\pi k}{M}m}}\right] \\ 2\mathrm{Re}\left[\frac{e^{-i\frac{2\pi k}{M}2}}{1 + \sum_{m=1}^{r} c_m e^{-i\frac{2\pi k}{M}m}}\right] \\ \vdots \\ 2\mathrm{Re}\left[\frac{e^{-i\frac{2\pi k}{M}r}}{1 + \sum_{m=1}^{r} c_m e^{-i\frac{2\pi k}{M}m}}\right] \end{pmatrix} \tag{23}$$

the gradient of $\Gamma(\chi)$ with respect to $\chi$ is given by $$\left[\frac{\partial\Gamma(\chi)}{\partial\chi}\right]^T = (\Psi_1, \Psi_2, \ldots, \Psi_M) \tag{24}$$

The above algorithm (21) involves a lot of calculations for estimating $\hat{P}_\Gamma$. A major part of these calculations originates from the multiplication with, and the inversion of the (M×M) matrix $\hat{P}_\Gamma$. However, $\hat{P}_\Gamma$ is close to diagonal (see equation (18)) and may be approximated by $$\hat{P}_\Gamma \approx \frac{2r}{N}I = const \cdot I \tag{25}$$

where I denotes the (M×M) unity matrix. Thus, according to a preferred embodiment the following sub-optimal algorithm may be used $$G(k) = \left[ \frac{\partial \Gamma(\chi)}{\partial \chi} \bigg|_{\chi=\hat{\chi}(k)} \right]^T \tag{26}$$

$$\hat{\chi}(k+1) = \hat{\chi}(k) + [G(k)G^T(k)]^{-1} G(k)[\hat{\Gamma} - \Gamma(\hat{\chi}(k))]$$

with initial estimates $\Gamma$ and $\hat{\chi}(0)$. In (26), $G(\kappa)$ is of size $((r+1)\times M)$.

References

[1] J. D. Gibson, B. Koo and S. D. Gray, "Filtering of colored noise for speech enhancement and coding", *IEEE Transaction on Acoustics, Speech and Signal Processing*", vol. 39, no. 8, pp. 1732–1742, August 1991.

[2] D. K. Freeman, G. Cosier, C. B. Southcott and I. Boyd, "The voice activity detector for the pan-European digital cellular mobile telephone service" 1989 *IEEE International Conference Acoustics, Speech and Signal Processing,* 1989, pp. 489–502.

[3] J. S. Lim and A. V. Oppenheim, "All-pole modeling of degraded speech", *IEEE Transactions on Acoustics, Speech, and Signal Processing*, Vol. ASSp-26, No. 3, June 1978, pp. 228–231.

[4] T. Söderström, P. Stoica, and B. Friedlander, "An indirect prediction error method for system identification", *Automatica*, vol. 27, no. 1, pp. 183–188, 1991.

What is claimed is:

1. A noisy speech parameter enhancement method, comprising the steps of receiving background noise samples and noisy speech samples;

determining a background noise power spectral density estimate at M frequencies, where M is a predetermined positive integer, from a first collection of background noise samples;

estimating p autoregressive parameters, where p is a predetermined positive integer significantly smaller than M, and a first residual variance from a second collection of noisy speech samples;

determining a noisy speech power spectral density estimate at said M frequencies from said p autoregressive parameters and said first residual variance;

determining an enhanced speech power spectral density estimate by subtracting said background noise spectral density estimate multiplied by a predetermined positive factor from said noisy speech power spectral density estimate; and determining r enhanced autoregressive parameters using an iterative algorithm, where r is a predetermined positive integer, and an enhanced residual variance from said enhanced speech power spectral density estimate using an iterative algorithm.

2. The method of claim 1, including the step of restricting said enhanced speech power spectral density estimate to non-negative values.

3. The method of claim 2, wherein said predetermined positive factor has a value in the range 0–4.

4. The method of claim 3, wherein said predetermined positive factor is approximately equal to 1.

5. The method of claim 4, wherein said predetermined integer r is equal to said predetermined integer p.

6. The method of claim 5, including the steps of estimating q autoregressive parameters, where q is a predetermined positive integer smaller than p, and a second residual variance from said first collection of background noise samples;

determining said background noise power spectral density estimate at said M frequencies from said q autoregressive parameters and said second residual variance.

7. The method of claim 6, including the step of averaging said background noise power spectral density estimate over a predetermined number of collections of background noise samples.

8. The method of claim 1 including the step of averaging said background noise power spectral density estimate over a predetermined number of collections of background noise samples.

9. The method of claim 1, including the step of using said enhanced autoregressive parameters and said enhanced residual variance for adjusting a filter for filtering a third collection of noisy speech samples.

10. The method of claim 9, wherein said second and said third collection of noisy speech samples are formed by the same collection.

11. The method of claim 10, including the step of Kalman filtering said third collection of noisy speech samples.

12. The method of claim 9, including the step of Kalman filtering said third collection of noisy speech samples.

13. A noisy speech parameter enhancement apparatus, comprising means for receiving background noise samples and noisy speech samples;

means for determining a background noise power spectral density estimate at M frequencies, where M is a predetermined positive integer, from a first collection of background noise samples;

means for estimating p autoregressive parameters, where p is a predetermined positive integer significantly smaller the M, and a first residual variance from a second collection of noisy speech samples;

means for determining a noisy speech power spectral density estimate at said M frequencies from said p autoregressive parameters and said first residual variance;

means for determining an enhanced speech power spectral density estimate by subtracting said background noise spectral density estimate multiplied by a predetermined factor from said noisy speech power spectral density estimate using an iterative algorithm; and means for determining r enhanced autoregressive parameters using an iterative algorithm, where r is a predetermined positive integer, and an enhanced residual variance from said enhanced speech power spectral density.

14. The apparatus of claim 13, including means for restricting said enhanced speech power spectral density estimate to non-negative values.

15. The apparatus of claim 14, including means for estimating q autoregressive parameters, where q is a predetermined positive integer smaller than p, and a second residual variance from said first collection of background noise samples;

means for determining said background noise power spectral density estimate at said M frequencies from said q autoregressive parameters and said second residual variance.

16. The apparatus of claim 15, including means for averaging said background noise power spectral density estimate over a predetermined number of collections of background noise samples.

17. The apparatus of claim 13, including means for averaging said background noise power spectral density estimate over a predetermined number of collections of background noise samples.

18. The apparatus of claim 13, including means for using said enhanced autoregressive parameters and said enhanced residual variance for adjusting a filter for filtering a third collection of noisy speech samples.

19. The apparatus of claim 18, including a Kalman filter for filtering said third collection of noisy speech samples.

20. The apparatus of claim 18, including a Kalman filter for filtering said third collection of noisy speech samples, said second and said third collection of noisy speech samples being being the same collection.

* * * * *